US009850088B2

(12) United States Patent
Maeda et al.

(10) Patent No.: US 9,850,088 B2
(45) Date of Patent: Dec. 26, 2017

(54) SHEET CONVEYING DEVICE, IMAGE FORMING APPARATUS WITH SHEET CONVEYING DEVICE, AND METHOD OF CORRECTING SKEW OF SHEET BY USING SHEET CONVEYING DEVICE

(71) Applicants: Takatsugu Maeda, Ibaraki (JP); Toshihiro Nakagaki, Kanagawa (JP); Takeshi Uchida, Kanagawa (JP); Satoshi Ueda, Ibaraki (JP)

(72) Inventors: Takatsugu Maeda, Ibaraki (JP); Toshihiro Nakagaki, Kanagawa (JP); Takeshi Uchida, Kanagawa (JP); Satoshi Ueda, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/953,558

(22) Filed: Nov. 30, 2015

(65) Prior Publication Data

US 2016/0152431 A1 Jun. 2, 2016

(30) Foreign Application Priority Data

Nov. 28, 2014 (JP) ..... 2014-241362

(51) Int. Cl.
*B65H 9/04* (2006.01)
*B65H 9/00* (2006.01)
(Continued)

(52) U.S. Cl.
CPC ..... *B65H 9/004* (2013.01); *B65H 5/062* (2013.01); *B65H 5/068* (2013.01); *B65H 9/14* (2013.01);
(Continued)

(58) Field of Classification Search
CPC ..... B65H 5/062; B65H 5/068; B65H 9/004; B65H 9/006; B65H 9/10; B65H 9/14;
(Continued)

(56) References Cited

U.S. PATENT DOCUMENTS 7,810,809 B2 * 10/2010 Inui ..... B65H 9/166 271/248
8,348,266 B2 * 1/2013 Deno ..... B65H 5/38 271/245
(Continued)

FOREIGN PATENT DOCUMENTS

JP 2007-106572 4/2007
JP 2008-024507 2/2008
(Continued)

*Primary Examiner* — Prasad V Gokhale
(74) *Attorney, Agent, or Firm* — Harness, Dickey & Pierce, P.L.C.

(57) ABSTRACT

A sheet conveying device includes a sheet skew corrector to correct a skew of a leading end of a sheet inclining from a sheet conveyance direction and a pair of registration rollers disposed upstream of the sheet skew corrector in the sheet conveyance direction. The pair of registration rollers freely contacts and separates from each other. The pair of registration rollers conveys the sheet downstream of the sheet skew corrector in the sheet conveyance direction when driven at a prescribed time. A pair of conveyance rollers is placed upstream of the pair of registration rollers in the sheet conveyance direction. The pair of conveyance rollers continuously sandwiches the sheet from when the sheet with the skew corrected is sandwiched by the pair of registration rollers to when a trailing end of the sheet passes between the pair of conveyance rollers.

19 Claims, 5 Drawing Sheets

(51) Int. Cl.
*B65H 9/14* (2006.01)
*B65H 5/06* (2006.01)

(52) U.S. Cl.
CPC ..... *B65H 2404/144* (2013.01); *B65H 2404/6111* (2013.01)

(58) Field of Classification Search
CPC ..... B65H 2404/144; B65H 2404/1441; B65H 2404/70; B65H 2404/72; B65H 2404/721; B65H 2404/722; B65H 2404/725
USPC ..... 271/245, 246
See application file for complete search history.

(56) References Cited

U.S. PATENT DOCUMENTS

2007/0023995 A1* 2/2007 Onodera ..... B65H 9/006 271/226
2008/0003031 A1 1/2008 Tsuchiya et al.
2008/0251998 A1* 10/2008 Muneyasu ..... B65H 5/34 271/227
2009/0317114 A1 12/2009 Uchida et al.
2012/0153565 A1* 6/2012 Deno ..... B65H 5/38 271/226
2012/0169006 A1* 7/2012 Matsuda ..... B65H 5/062 271/3.19
2013/0214482 A1* 8/2013 Matsumoto ..... B65H 7/10 271/228
2013/0320616 A1 12/2013 Nakagaki

FOREIGN PATENT DOCUMENTS

JP 2008024507 A * 2/2008 ..... B65H 9/004
JP 2008-230837 10/2008
JP 2010-215374 9/2010
JP 2011-178569 9/2011
JP 2013-216444 10/2013
JP 2014-005147 1/2014

* cited by examiner

| LENGTH OF SHEET CONVEYANCE PATH L1 | 350 | 500 |
|---|---|---|
| CORRECTION OF SHEET SKEW | FAILURE | SUCCESS |

| RADIUS OF CURVATURE OF CURVED SHEET CONVEYANCE PATH [mm] | 80 | 100 |
|---|---|---|
| CORRECTION OF SHEET SKEW | FAILURE | SUCCESS |

SHEET CONVEYING DEVICE, IMAGE FORMING APPARATUS WITH SHEET CONVEYING DEVICE, AND METHOD OF CORRECTING SKEW OF SHEET BY USING SHEET CONVEYING DEVICE

CROSS-REFERENCE TO RELATED APPLICATION

This patent application is based on and claims priority pursuant to 35 U.S.C. §119(a) to Japanese Patent Application No. 2014-241362, filed on Nov. 28, 2014, in the Japan Patent Office, the entire disclosure of which is hereby incorporated by reference herein.

BACKGROUND

Technical Field

Embodiments of this invention relate to a sheet conveying device and an image forming apparatus employing the sheet conveying device.

Related Art

Hitherto, in image forming apparatuses such as printers, copiers, etc., since the sheet is sometimes skewed when conveyed from a sheet feeding unit, a known system corrects this skew of the sheet.

For example, a gate (i.e., a sheet skew corrector for correcting a skew of the sheet) is placed downstream of a pair of registration rollers in a sheet conveyance direction to open and close a paper sheet conveyance path for the paper sheet. When the paper sheet conveyance path is closed by the gate while the pair of registration rollers is separated from each other, the pair of conveyance rollers placed upstream of the pair of registration rollers in the paper sheet conveyance direction is driven to bring a leading end of the paper sheet in contact with the gate. Since the paper sheet is further conveyed for a predetermined period of time even after being brought into contact with the gate, the leading end of the paper sheet abuts against and is aligned with an abutment face of the gate, thereby making a right angle with the paper sheet conveyance direction. Subsequently, the pair of registration rollers contacts each other to sandwich the paper sheet to regulate movement of a leading end region of the paper sheet while keeping the leading end of the paper sheet contacting the gate. As a result, the skew of the paper sheet caused in the leading end region of the paper sheet between a portion thereof sandwiched by the pair of registration rollers and the leading end thereof is corrected.

At this moment, since a trailing end region of the paper sheet located upstream of the portion sandwiched by the pair of registration rollers is sometimes obliquely sandwiched by the pairs of conveyance rollers, the trailing end region of the paper sheet inclines to the leading end of the paper sheet thereby generating torsion in the paper sheet. In such a torsional condition, however, when the gate is opened the pair of conveyance rollers is at the same time separated, so that the trailing end of the paper sheet can make the right angle with the paper sheet conveyance direction as the portion sandwiched by the pair of registration rollers. Hence, the torsion of the paper sheet is thereby wholly eliminated therefrom. Thus, when the pair of registration rollers is driven at a prescribed time after that, the paper sheet is sent to a transfer section with the skew corrected.

SUMMARY

Accordingly, one aspect of the present invention provides a novel sheet conveying device that includes: a sheet skew corrector to correct a skew of a leading end of a sheet inclining from a sheet conveyance direction; and a pair of registration rollers disposed upstream of the sheet skew corrector in the sheet conveyance direction. The pair of registration rollers freely contacts and separates from each other. The pair of registration rollers conveys the sheet downstream of the sheet skew corrector in the sheet conveyance direction when driven at a prescribed time. A pair of conveyance rollers is placed upstream of the pair of registration rollers in the sheet conveyance direction. The pair of conveyance rollers continuously sandwiches the sheet from when the sheet with the skew corrected by the sheet skew corrector is sandwiched by the pair of registration rollers to when a trailing end of the sheet passes between the pair of conveyance rollers.

Another aspect of the present invention provides a novel image forming apparatus that includes an image forming device to form an image on a sheet and the sheet conveying device to convey the sheet toward the image forming device. In the sheet conveying device, torsion of a paper sheet caused when a skew thereof is corrected is cancelled while inhibiting the paper sheet from returning to the sheet skew once again.

Yet another aspect of the present invention provides a novel method of correcting a skew of a sheet. The method includes the steps of: conveying a sheet inclining from a sheet conveyance direction downstream along a sheet conveyance path with a pair of conveyance rollers toward a pair of registration rollers in the sheet conveyance direction while sandwiching the sheet therebetween; separating a pair of registration rollers from each other to open a sheet conveyance path to allow the sheet conveyed by the pair of conveyance rollers to pass therethrough; and conveying a sheet though the pair of registration rollers separating from each other with a pair of bumping rollers disposed between the pair of conveyance rollers and the pair of registration rollers. The method further includes the steps of: bumping a leading end of the sheet with the pair of bumping rollers against a sheet skew corrector disposed downstream of the pair of registration rollers in the sheet conveyance direction; correcting a skew of the leading end with the sheet skew corrector by further conveying the sheet bumping against the sheet skew corrector downstream for a predetermined period of time; and sandwiching the sheet with the skew of the leading end corrected by bringing the pair of registration rollers in contact with each other to close the sheet conveyance path. The method further includes the steps of: separating the pair of bumping roller from each other to open the sheet conveyance path; retracting the sheet skew corrector from the sheet conveyance path to open the sheet conveyance path; and driving the pair of registration rollers sandwiching the sheet therebetween at a prescribed time. The method further includes the steps of conveying the sheet downstream of the sheet skew corrector in the sheet conveyance direction with the pair of registration rollers; and continuously sandwiching the sheet with the pair of conveyance rollers from when the step of sandwiching the sheet with the skew of the leading end corrected by bringing the pair of registration rollers in contact with each other to close the sheet conveyance path is executed until a trailing end of the sheet with the skew of the leading end corrected passes between the pair of conveyance rollers.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

In the above-described conventional sheet conveying device, before the pair of conveyance rollers is separated, either the trailing end of the paper sheet or a surface of a trailing end region of the paper sheet sometimes contacts a guide plate, such as a bottom plate, a ceiling plate, a side plate, etc. As a result, friction is generated by a contact portion of the trailing end of the paper sheet and/or the surface of the trailing end region of the paper sheet contacting the guide plate. Hence, when the friction is great, the trailing end of the paper sheet cannot precisely make the right angle with the paper sheet conveyance direction even if the pair of conveyance rollers separates. In addition, restoring force generated in the paper sheet in such a situation is obliquely applied from the paper sheet conveyance direction to the portion sandwiched by the pair of registration rollers as well. As a result, when the gate is opened (i.e., retracted from the sheet conveyance path), the paper sheet sandwiched by the pair of registration rollers is directed obliquely. Accordingly, when the paper sheet is conveyed by the pair of registration rollers while keeping the skew, the paper sheet conveyed toward the transfer section is likely in the skew.

Figure 1:
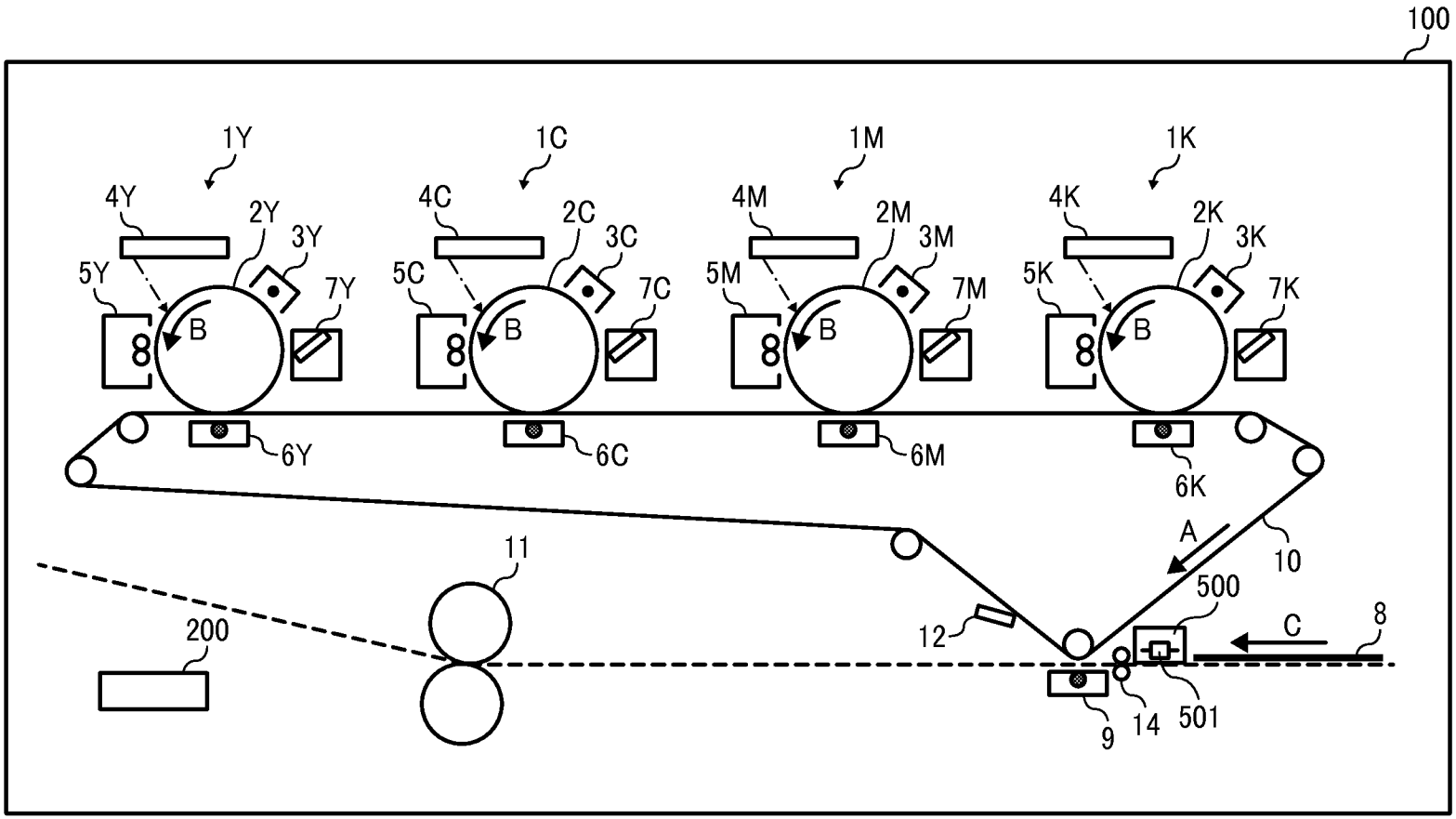
FIG. 1 is a diagram schematically illustrating an exemplary printer as an image forming apparatus according to one embodiment of the present invention.

Referring now to the drawings, wherein like reference numerals designate identical or corresponding parts throughout the several views thereof, and in particular to FIG. 1, an exemplary printer employing an electrographic system (herein after simply referred to as a printer) is described as one example of an image forming apparatus according to one embodiment of the present invention that solves the above-described problem. As schematically illustrated in FIG. 1, the printer 100 according to this embodiment of the present invention has the below described exemplary basic configuration. Specifically, the printer 100 is a full-color (i.e., four component colors) type image forming apparatus and an outline thereof is as follows. The printer 100 includes four image forming units 1Y, 1C, 1M, and 1K placed along an intermediate transfer belt 10 in a running direction of the intermediate transfer belt 10. The image forming unit 1Y is mainly composed of a photoconductive drum 2Y, a drum electric charging unit 3Y, an exposing unit 4Y, a developing unit 5Y, a transfer unit 6Y, and a cleaning unit 7Y or the like. The other remaining image forming units 1C to 1K are similarly configured as the image forming unit 1Y as well. In the following descriptions, multiple suffix alphabets y, c, m, and k respectively indicate members used to form images of yellow, cyan, magenta, and black, respectively.

For example, upon receiving an instruction signal for starting image forming operation from a control unit (200), the photoconductive drum 2Y starts rotating in a direction as shown by arrow B in FIG. 1 until completion of the image forming operation. When the photoconductive drum 2Y starts such rotation, the electric charging unit 3Y receives a high voltage (e.g., from an electric charge high voltage power supply 214) and negatively electrifies a surface of the photosensitive drum 2Y uniformly. When the control unit (200) sends dot images converted from graphic data and/or character data to the image forming apparatus (i.e., the printer 100) as on/off signals to turn on and off the exposing unit 4Y, respectively, the surface of the photoconductive drum 2Y is separated into a first surface portion irradiated with a laser light beam emitted from the exposing unit 4Y and a second surface portion not irradiated with the laser light beam emitted therefrom at the same time. As a result, an amount of electric charge borne in the first surface portion of the photoconductive (PC) drum 2Y decreases due to receiving of the laser light beam from the exposing unit 4Y. By contrast, an amount of electric charge borne in the second surface portion of the photoconductive (PC) drum 2Y does not decrease due to not receiving the laser light beam from the exposing unit 4Y, When the first surface portion of the photoconductive (PC) drum 2Y with the decreased amount of electric charge reaches a prescribed position opposed to the developing unit 5Y as the photoconductive drum 2Y rotates, negatively charged yellow toner (Y toner) adheres to the first surface portion of the photoconductive drum 2Y having the decreased electric charge, thereby forming a yellow color toner image (Y toner image) thereon.

When the toner image formed on the photoconductive drum 2Y subsequently reaches the transfer unit 6Y acting as a primary transfer device, the Y toner image is primarily transferred onto the intermediate transfer belt 10 that is rotating in a direction as shown by arrow A in FIG. 1 under influence of a high voltage applied to the transfer unit 6Y (e.g., from a primary transfer high voltage power supply 212). Y toner residue not transferred and remaining on the photoconductive drum 2Y even after passing through a transfer position of the transfer unit 6Y is removed therefrom by a cleaning unit 7Y to prepare for the next image forming operation.

After the image forming operation is executed in the image forming unit 1Y, similar image forming operation is sequentially executed in the image forming unit 1C. That is, a cyan color toner image (C toner image) is formed on the photoconductive drum 2C and is then primarily transferred onto the intermediate transfer belt 10 under influence of a high voltage applied to the transfer device 6C (e.g., from a primary transfer high voltage power supply 212) as well.

At this moment, such primarily transfer operation of the C toner image borne on the photoconductive drum 2C onto the intermediate transfer belt 10 is executed in synchronism with the Y toner image, which is previously formed in the image forming unit 1Y, primarily transferred and borne on the intermediate transfer belt 10, and reaches the transfer unit 6C. With this, the Y and C toner images formed in the image forming units 1Y and 1C, respectively, overlap with each other at a prescribed position on the intermediate transfer belt 10, accordingly. Similarly, magenta and black toner images (M and K toner images) are formed on the remaining image forming units 1M and 1K, respectively, and are secondarily transferred and superimposed on the intermediate transfer belt 10 at the prescribed position similarly as well. Hence, a full-color image is ultimately formed on the intermediate transfer belt 10.

When the above-described full-color image reaches a paper sheet targeted transfer device 9 acting as a secondary transfer device, the paper sheet 8 conveyed from the paper sheet feeding unit installed in the printer 100 in a direction as shown by arrow C in FIG. 1 reaches the paper sheet targeted transfer device 9. Due to a high-voltage applied again to the paper sheet targeted transfer device 9, the full-color image borne on the intermediate transfer belt 10 is effectively transferred at once onto the paper sheet 8. The paper sheet 8 is subsequently conveyed to a fixing unit 11. The toner image borne on the paper sheet 8 is fused and fixed by the fixing unit 11 thereon. Meanwhile, untransferred Y, M, C, and K toner particles adhering to and remaining on the intermediate transfer belt 10 even when the full-color image passes through a secondary transfer position of the transfer device 9 is removed therefrom by a belt cleaning mechanism 12.

Here, a main unit controller 200 controls operation of each of the other units installed in the printer 100 and one or more devices included in each of the other units.

Now, the main unit controller 200 is described in detail with reference to FIG. 2.

Figure 2:
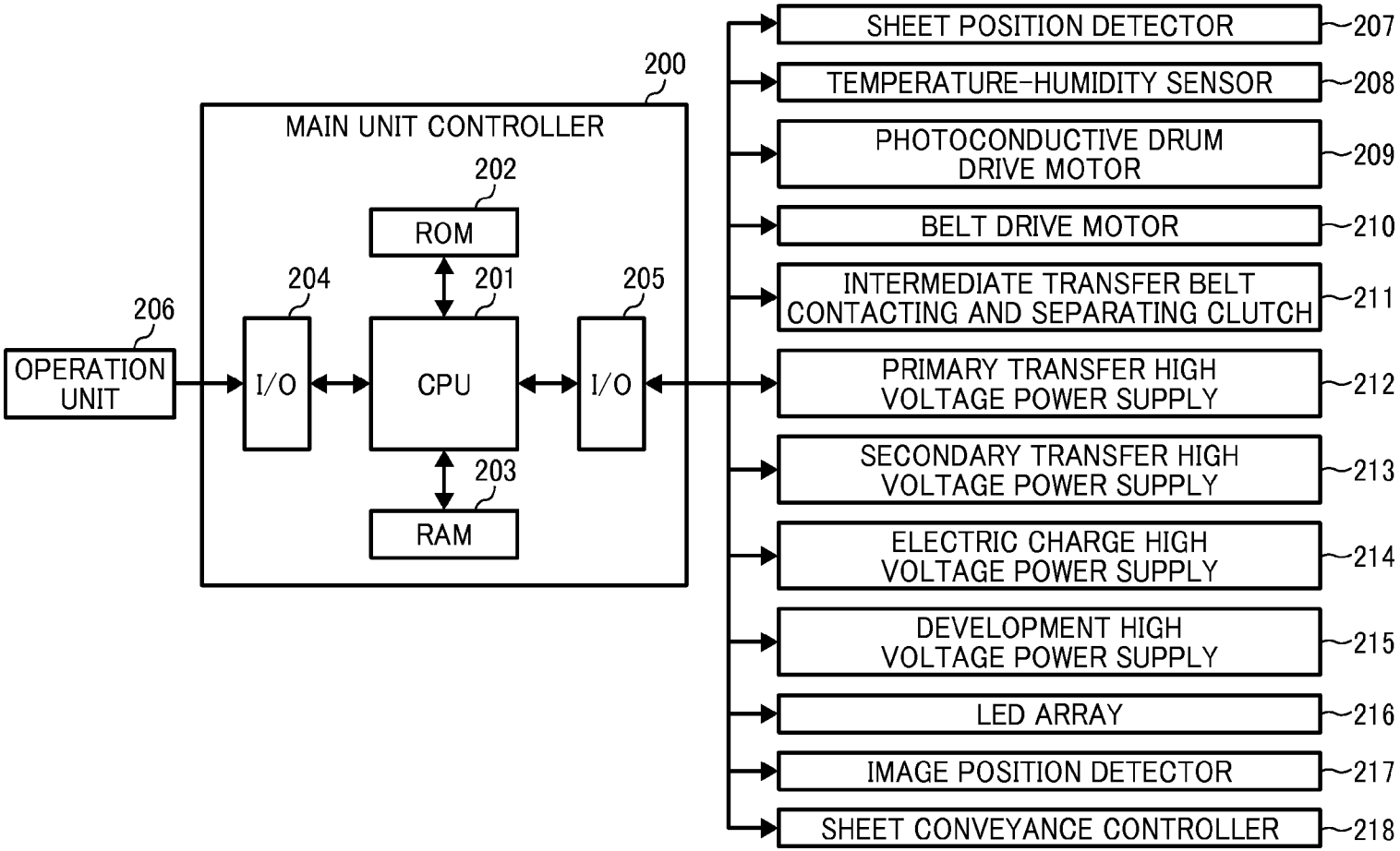
FIG. 2 is a block diagram illustrating an exemplary control system employed in the printer of FIG. 1 according to one embodiment of the present invention.

That is, FIG. 2 is a block diagram illustrating an exemplary control system employed in the printer 100. As shown there, the main unit controller 200 includes a central processing unit (CPU) 201, a memory mainly composed of a ROM (Read Only Memory) 202 and a RAM (Random Access Memory) 203 or the like, and a pair of I/O (Input and Output) ports 204 and 205 each to input and output signals. The I/O port 204 is connected to an operation unit 206. The I/O port 205 is connected to a paper sheet position detector 207, a temperature humidity sensor 208, and a photoconductive drum drive motor 209 as well. The I/O port 205 is also connected to a belt drive motor 210, an intermediate transfer belt contacting and separating clutch 211, and a primary transfer high voltage power supply 212. The I/O port 205 is also connected to a secondary transfer high voltage power supply 213, an electric charging high voltage power supply 214, and a development high voltage power supply 215. The I/O port 205 is also connected to an LED (Light Emitting Diode) array 216, an image position detector 217, and a paper sheet conveyance controller 218 or the like as well.

The paper sheet position detector 207 optically detects a leading end of the paper sheet 8 sent by a pair of separable registration rollers (14) after it starts rotating. The temperature humidity sensor 208 acquires environmental information of an interior of the printer 100. When a black and white image (i.e., a monochrome image) is formed, the intermediate transfer belt contacting and separating clutch 211 switches a track of the intermediate transfer belt 10 from a previous track to another track by separating the intermediate transfer belt 10 from the photoconductive drums 2 of respectively component colors of Y, M, C other than black included in the image forming units 1.

Now, an exemplary characteristic feature of a sheet conveying device as one embodiment of the present invention is described herein below.

Figure 3:
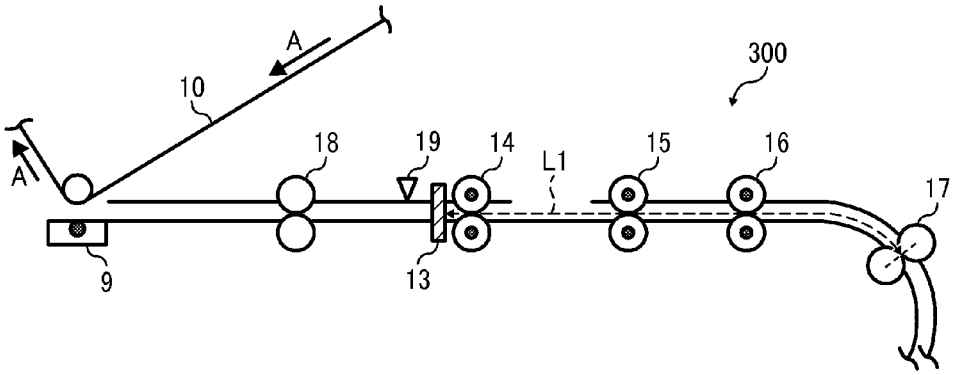
FIG. 3 is a diagram schematically illustrating an exemplary sheet conveying device installed in the printer of FIG. 1 according to one embodiment of the present invention.

That is, FIG. 3 is a diagram schematically illustrating an exemplary configuration of the sheet conveying device 300 installed in the printer 100. The sheet conveying device 300 shown in FIG. 3 includes a gate 13, the a pair of separable registration rollers 14, and a pair of first separable conveyance rollers 15 acting as a bumping roller to bump a tip of the paper sheet 8 against the gate 13. The sheet conveying device 300 also includes a pair of second separable conveyance rollers 16 acting as a pair of driving rollers, a pair of third inseparable conveyance rollers 17, and a pair of fourth conveyance rollers 18. The sheet conveying device 300 further includes a paper sheet detector 19. The gate 13 is placed downstream of the pair of separable registration rollers 14 to open and close a paper sheet conveyance path. That is, the pair of separable registration rollers 14 is placed upstream of the gate 13 in a paper sheet conveyance direction. Each of the pair of first separable conveyance rollers 15, the pair of second separable conveyance rollers 16, and the pair of third inseparable conveyance rollers 17 is placed upstream of the pair of separable registration rollers 14 in the paper sheet conveyance direction a swell. By contrast, the pair of fourth conveyance rollers 18 is placed between the paper sheet detector 19 described later in more detail and the paper sheet targeted transfer device 9 to convey the paper sheet 8 toward the paper sheet targeted transfer device 9. Each of the pair of separable registration rollers 14, the pair of first separable conveyance rollers 15, and the pair of second separable conveyance rollers 16 includes a separating mechanism that enables each of the pair of separable registration rollers 14, the pair of first separable conveyance rollers 15, and the pair of second separable conveyance rollers 16 to separate from each other and contact and sandwich the paper sheet therebetween. The pair of third inseparable conveyance rollers 17 is positioned in a curved paper sheet conveyance path formed upstream of the pair of second separable conveyance rollers 16 in the paper sheet conveyance direction. Hence, the pair of third inseparable conveyance rollers 17 conveys the paper sheet 8 while applying driving force thereto. The paper sheet detector 19 acting as a paper sheet sensor is disposed right downstream of the gate 13 in the paper sheet conveyance direction to detect a leading end of the paper sheet 8.

The sheet conveying device 300 is configured to convey multiple sheets of various sizes of a different length in the paper sheet conveyance direction. Hence, to convey the minimum size of a paper sheet, the pair of first separable conveyance rollers 15, the pair of second separable conveyance rollers 16, and the pair of third inseparable conveyance rollers 17 each placed upstream of the pair of separable registration rollers 14 is positioned at prescribed intervals shorter than the length of the paper sheet of the minimum size in the paper sheet conveyance direction. Further, to convey multiple sheets respectively having different sizes longer than the minimum size, these pairs of conveyance rollers 15 to 17 are correspondingly placed at prescribed various positions to be able to sandwich trailing end regions of paper sheets of the different sizes therebetween, respectively.

In such a paper sheet conveying path having the multiple pairs of conveyance rollers 15 to 17, to eliminate the earlier described conventional problem in that the paper sheet returns to the skew again when the skew of the trailing end region of the paper sheet is corrected by opening all of the multiple pairs of conveyance rollers as caused in the conventional configuration, at least one of these pairs of conveyance rollers 15 to 17 can sandwich the paper sheet therebetween to the contrary. Here, to correct skews of paper sheets of all sizes by excessively feeding for a predetermined period of time and bumping leading ends of the respective paper sheets against the gate 13, at least the pair of conveyance rollers for the paper sheet having the minimum size can sandwich the paper sheets of all sizes. However, since a distance between the pair of conveyance rollers for the paper sheet of the minimum size and the pair of registration rollers is short, restoring force generated in the paper sheet due to torsion of the paper sheet grows. As a result, the paper sheet sandwiched by the pair of separable registration rollers 14 is likely directed obliquely due to influence of strong restoring force generated in the paper sheet. Under such a condition, when the paper sheet is conveyed by the pair of registration rollers driven by a prescribed driving source, the paper sheet may be conveyed to the transfer section (i.e., the transfer device 9) with its skew.

In the sheet conveying device 300, the paper sheet is guided by a guide plate, such as a bottom plate, a ceiling plate, a side plate, etc., along the paper sheet conveyance path. Hence, when the skew of a leading end region of the paper sheet is corrected by the gate 13, the trailing end region of the paper sheet sometimes contacts the guide plate. In such a situation, if frictional force caused by contact resistance of a contact point between the paper sheet and the guide plate is weak enough, the skew of the trailing end region of the paper sheet is equivalently corrected as the portion of the paper sheet sandwiched by the pair of separable registration rollers 14 by releasing the trailing end region of the paper sheet from restriction of the multiple pairs of conveyance rollers as in the conventional system. By contrast, however, if the frictional force caused by the contact resistance is relatively great, the restoring force of the paper sheet caused by the torsion thereof is increased in accordance with rigidity of the paper sheet, and is strongly applied to the portion of the paper sheet sandwiched by the pair of separable registration rollers 14. As a result, the paper sheet sandwiched by the pair of separable registration rollers 14 is likely directed obliquely, and the paper sheet may be conveyed to the transfer section keeping the skew as the pair of separable registration rollers 14 rotates under such a condition.

Especially, when a long paper sheet having a long size in the paper sheet conveyance direction is utilized, a paper sheet portion located on the trailing end side of the portion sandwiched by the pair of separable registration rollers 14 is relatively long. Accordingly, either an area of the paper sheet that contacts the guide plate via an area surface thereof or the number of contact sections increases on the trailing end side of the paper sheet. As a result, since frictional force caused by contact resistance increases and restoring force caused by torsion of the long paper sheet is strongly applied to the portion of the paper sheet sandwiched by the pair of separable registration rollers 14, the long paper sheet is more likely conveyed in the horizontal rotated state toward the transfer section. Otherwise, even if the paper sheet on the trailing end side of the paper sheet is released from the above-described restriction as in the conventional system, the paper sheet remains contacting with the guide plate and accordingly the skew of the long paper sheet on the trailing end side thereof cannot be corrected. That is, when the pair of separable registration rollers 14 rotates under such a condition, the paper sheet 8 is conveyed toward the transfer section with its increasing skew. Here, according to below described various embodiments of the present invention, various operations are executed in a sheet conveying device to eliminate the above-described problems therefrom.

Figure 4A:
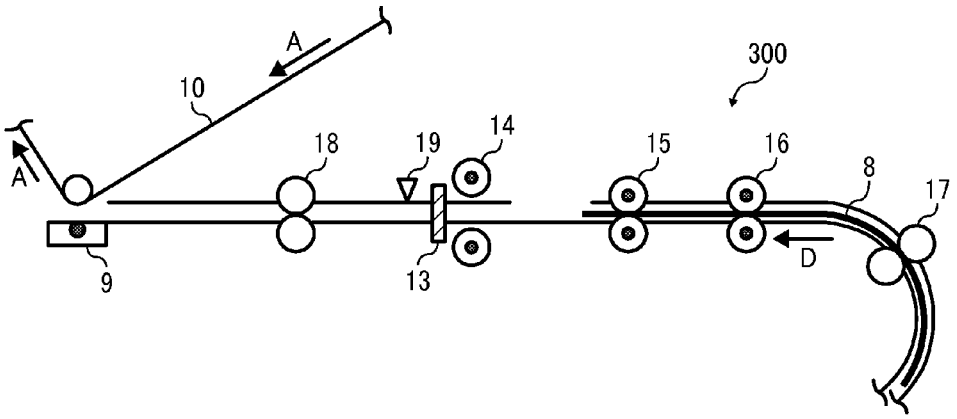
FIGS. 4A and 4B are diagrams schematically illustrating movement of a paper sheet correctively when a skew of the paper sheet is corrected according to one embodiment of the present invention.
Figure 4B:
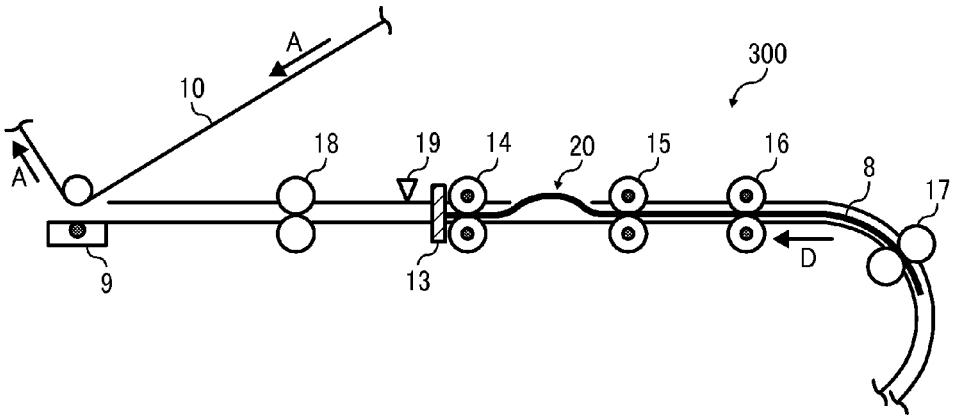

Now, correcting a skew of a paper sheet in the sheet conveying device according to one embodiment of the present invention is herein below described with reference to FIGS. 4A to 5D and other applicable drawings. That is, FIGS. 4A to 5D are diagrams schematically illustrating exemplary movement of a paper sheet collectively when a skew of the paper sheet is corrected. As shown in FIGS. 4A to 4B, the paper sheet 8 launched from the paper sheet feeding unit is conveyed toward the gate 13 by the multiple pairs of conveyance rollers 15 to 17 in the paper sheet conveyance direction as shown by arrow D in FIGS. 4A to 4B. At this moment, as shown in FIG. 4A, before the paper sheet 8 reaches the pair of separable registration rollers 14, the pair of separable registration rollers 14 is separated from each other and the gate 13 closes the paper sheet conveyance path at the same time. Hence, as shown in FIG. 4B, a leading end of the paper sheet 8 is conveyed and abuts against an abutment face of the gate 13. The paper sheet 8 abutting against the abutment face of the gate 13 is further conveyed downstream excessively for a predetermined period of time in the paper sheet conveyance direction by the multiple pairs of conveyance rollers 15 to 17 keeping the condition of abutting the abutment face of the gate 13 at the leading end thereof. The leading end of the paper sheet 8 accordingly aligns with the abutment face of the gate 13, thereby correcting the skew of the paper sheet 8. Because the paper sheet 8 is conveyed far downstream in the paper sheet conveyance direction, a deflection 20 is generated in the paper sheet 8. Thus, when the pair of separable registration rollers 14 sandwiches the paper sheet 8 therebetween after the leading end of the paper sheet 8 abuts against the gate 13 and is excessively sent downstream thereafter for the predetermined period of time, the skew of the paper sheet 8 is ultimately corrected. Meanwhile, since the trailing end region of the paper sheet 8 is sandwiched by the multiple pairs of conveyance rollers 15 to 17, a torsional condition of the paper sheet 8 is yet maintained such that the trailing end region of the paper sheet 8 remains the skew regarding the a leading end region of the paper sheet 8.

Figure 5A:
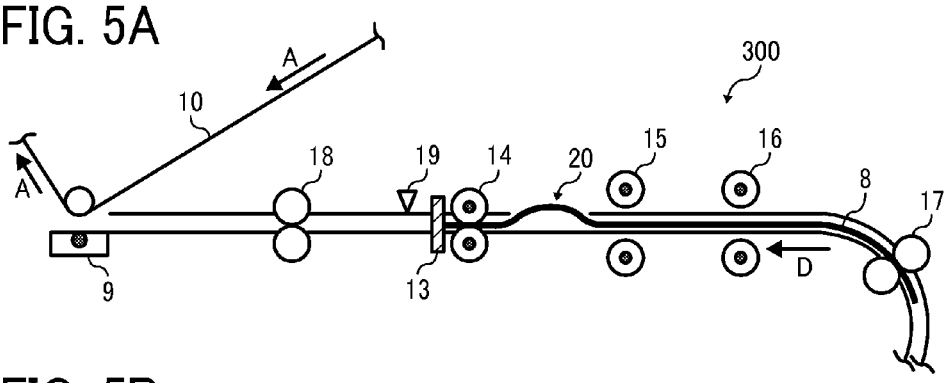
FIGS. 5A to 5D are diagrams schematically illustrating successive movement of the paper sheet correctively when a skew of the paper sheet is corrected according to one embodiment of the present invention.

Subsequently, as shown in FIG. 5A, each of the pair of first separable conveyance rollers 15 and the pair of second separable conveyance rollers 16 is separated from each other to avoid the below described problem. That is, if the pair of first separable conveyance rollers 15 and the pair of second separable conveyance rollers 16 each contact to sandwich the paper sheet 8 therebetween, since a distance between either the pair of first separable conveyance rollers 15 or the pair of second separable conveyance rollers 16 and the pair of separable registration rollers 14 is relatively short, restoring force of the paper sheet is relatively great when the gate 13 is opened (i.e., retracted from the paper sheet conveyance path) as shown in FIG. 5B due to deflection 20 and torsion of the paper sheet 8, and accordingly the portion of the paper sheet 8 sandwiched by the pair of separable registration rollers 14 is directed obliquely thereby returning to the sheet skew once again.

Figure 5B:
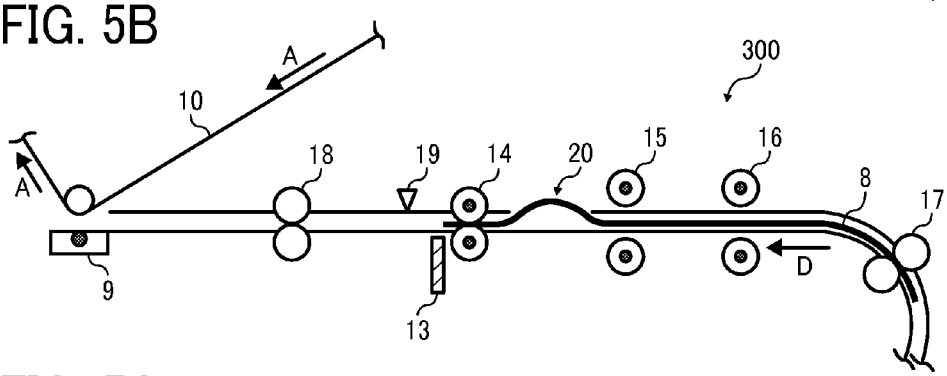
Figure 5C:
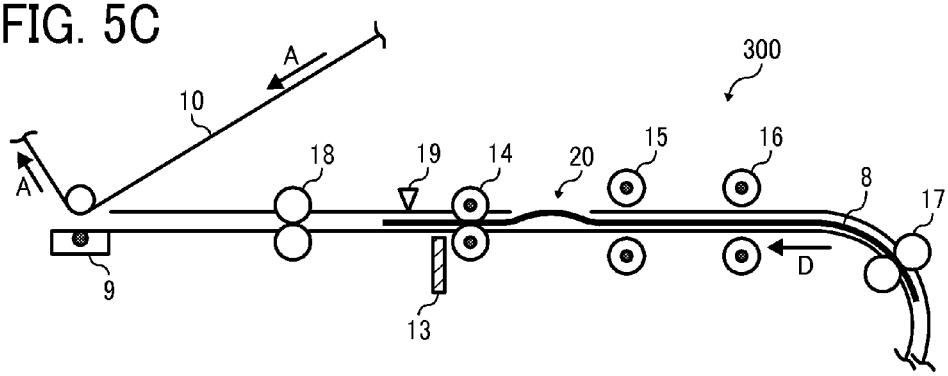

In view of this, as shown in FIG. 5B, when the gate 13 is opened, the paper sheet 8 is only sandwiched by both the pair of separable registration rollers 14 and the pair of third inseparable conveyance rollers 17 to be conveyed in the paper sheet conveyance direction. Subsequently, as shown in FIG. 5C, when the trailing end region of the paper sheet 8 has passed through the pair of third inseparable conveyance rollers 17, since the trailing end of the paper sheet 8 becomes free providing a free end thereof, the skew of the paper sheet 8 is equivalently corrected to the portion of the paper sheet 8 sandwiched by the pair of the registration rollers 14. When the paper sheet 8 is further conveyed by the pair of separable registration rollers 14 driven by a driving system, an amount of deflection 20 of the paper sheet 8 gradually decreases.

Figure 5D:
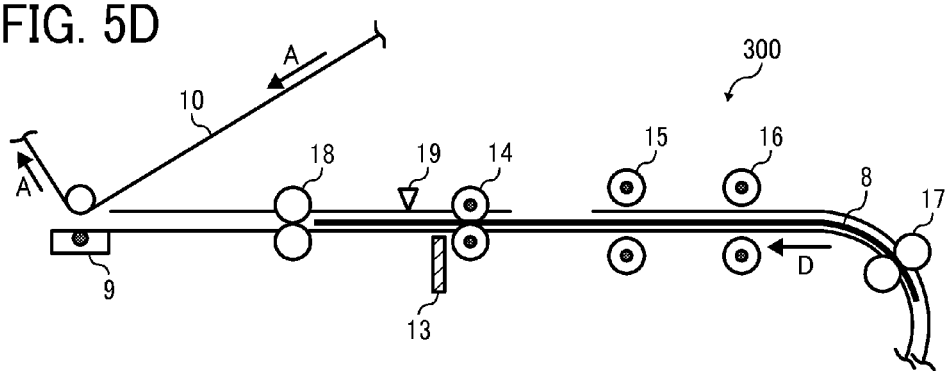

Subsequently, as shown in FIG. 5D, when the trailing end of the paper sheet 8 separates from the pair of third inseparable conveyance rollers 17, neither the deflection 20 nor the torsion is present in the paper sheet 8. Hence, the skew of the paper sheet 8 is corrected while holding the trailing end region of the paper sheet with the pair of conveyance rollers 17 therebetween on one hand, and both the deflection and the torsion of the paper sheet 8 generally caused during the above-described correction of the skew of the paper sheet 8 disappear at the same time as well on the other hand. Accordingly, when compared with a conventional system that increasingly employs a number of pairs of conveyance rollers with a separating mechanism as a size of a paper sheet 8 used in the sheet conveying device increases in a longitudinal direction, such as a long paper sheet, etc., the number of pairs of conveyance rollers with the separating mechanism can be minimized while saving the cost therefor even if the long paper sheet is utilized in this embodiment of the present invention.

That is, as shown in FIGS. 3 to 5D, according to this embodiment of the present invention, two pairs of first conveyance rollers 15 and second conveyance rollers 16 each enabled to separate from each other are placed upstream of the pair of separable registration rollers 14 in the paper sheet conveyance direction. However, the number of pairs of conveyance rollers is either increased or decreased depending on a length (i.e., a size) of a paper sheet 8 in the longitudinal direction to be conveyed. Here, as shown in FIG. 3, a reference code L1 shown by a broken line arrow indicates a length of a paper sheet conveyance path between the pair of separable registration rollers 14 and the pair of third inseparable conveyance rollers 17. That is, the length L1 of the paper sheet conveyance path determines a position at which the pair of third inseparable conveyance rollers 17 is disposed.

Now, a preferable degree of the length L1 of the paper sheet conveyance path is herein below described with reference to FIG. 6A that illustrates a result of experiment in which it is tested whether or not a skew of a paper sheet 8 is corrected when about 350 mm and about 500 mm are used as the length L1 of the paper sheet conveyance path.

Specifically, as described earlier, when the paper sheet 8 is excessively conveyed for the predetermined period of time after bumping against the gate 13 thereby forming deflection therein, restoring force caused by the deflection is sometimes relatively large. In such a situation, the pair of separable registration rollers 14 cannot precisely sandwich the paper sheet 8 therebetween, and the paper sheet 8 likely returns to the skew once again regarding the paper sheet conveyance direction. Further, either the trailing end of the paper sheet 8 or the surface of the trailing end region thereof sometimes contacts the guide plate constituting the conveyance path, such as the bottom plate, the ceiling plate, the side plate, etc. In such a situation, when frictional force generated by the above-described contact point is large, restoring force of the paper sheet directed in an oblique direction regarding the paper sheet conveyance direction is applied to a portion of the paper sheet sandwiched by the pair of separable registration rollers 14 therebetween. As a result, the paper sheet 8 sandwiched by the pair of separable registration rollers 14 is accordingly directed obliquely. When the obliquely directed paper sheet 8 is conveyed as is by the pair of separable registration rollers 14 driven by a prescribed driving system, the paper sheet 8 is conveyed in the skew once again.

In view of this, about 350 mm and about 500 mm are used as the length L1 of the paper sheet conveyance path extended from the gate 13 to the pair of third inseparable conveyance rollers 17 to test whether or not the paper sheet returns to the skew once again. Here, the full length of the paper sheet 8 used in the experiment is about 700 mm in the longitudinal direction. As shown as a testing result in FIG. 6A, when the pair of the third conveyance rollers 17 is placed at a portion having the length L1 of the paper sheet conveyance path of about 350 mm, the paper sheet 8 has returned to the skew once again. By contrast, however, when the pair of the third conveyance rollers 17 is placed at a portion having the length L1 of the paper sheet conveyance path of about 500 mm, the paper sheet 8 has not returned to the skew any more. As a result of this experiment, it is found that the pair of third inseparable conveyance rollers 17 is preferably placed at a prescribed position having the length L1 of the paper sheet conveyance path exceeding about 350 mm. Further, when the full length of the paper sheet 8 in the longitudinal direction is about 700 mm, it is also found that the pair of third inseparable conveyance rollers 17 is preferably placed at a prescribed position having the length L1 of the paper sheet conveyance path that ranges from about 470 mm to about 530 mm exceeding about 350 mm, for example. This is also effective when the full length of the paper sheet 8 is about 700 mm or more in the longitudinal direction.

Figures 6A, 6B, 7:
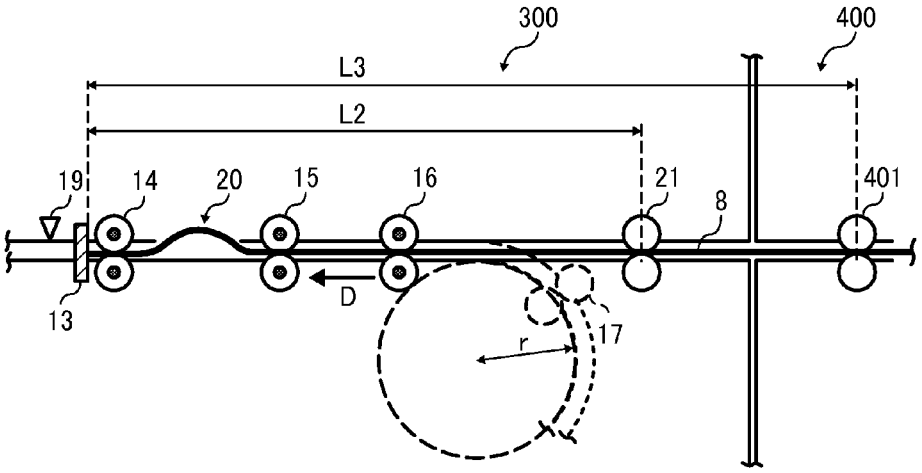
FIG. 6A is a table listing an exemplary experimental result of correction operation of correcting the skew of the paper sheet under conditions in that a reference code L1 as a length of a sheet conveyance path is about 350 mm and about 500 mm, respectively, according to one embodiment of the present invention.
FIG. 6B is also a table listing an exemplary experimental result of correction operation of correcting the skew of the paper sheet under conditions in that a radius of curvature of a curved sheet conveyance path disposed in the paper sheet conveyance path is about 80 mm and about 100 mm, respectively, according to another embodiment of the present invention.
FIG. 7 is a diagram schematically illustrating an exemplary modification of the sheet conveying device according to one embodiment of the present invention.

FIG. 6B is a table illustrating a result of experiment, in which it is tested whether or not the skew of the paper sheet 8 can be corrected when two different radiuses of curvature of about 80 mm and about 100 mm, is used for a curved paper sheet conveyance path. As shown there as a testing result, when the radius of curvature of the paper sheet conveyance path is about 80 mm, the paper sheet 8 has returned to the skew once again. By contrast, however, when the radius of curvature of the curved sheet conveyance path is about 100 mm, the skew of the paper sheet 8 has been corrected. Base on this experimental result, it is found that the radius of curvature of the curved sheet conveyance path is preferably about 80 mm or more.

Now, an exemplary modification of the sheet conveying device of this embodiment of the present invention is described herein below with reference to FIG. 7. That is, FIG. 7 illustrates the modification of the sheet conveying device of this embodiment of the present invention. As shown there, a paper sheet 8 is not fed from the paper sheet feeding unit installed in the image forming apparatus (i.e., the printer 100), but is fed from a preprocessing unit 400 separately disposed and connected to a main unit of the image forming apparatus (i.e., the printer 100). The preprocessing unit 400 may be a large capacity paper sheet feeding unit, for example. Accordingly, although a paper sheet is usually fed from the paper sheet feeding unit installed in the main unit of the image forming apparatus (the printer 100), it can be also fed from the preprocessing unit 400 as well. In this modification, the skew of the long paper sheet can be corrected again while sandwiching the long paper sheet with either a pair of fifth inseparable conveyance rollers 21 or a pair preprocessing inseparable conveyance rollers 401 as well in a similar manner as described earlier. However, instead of the paper sheet conveyance path as described with reference to FIG. 1, either a linear paper sheet path or a curved paper sheet path having a great radius of curvature (r) is employed to extend from the pair of separable registration rollers 14 to either the pair of fifth inseparable conveyance rollers 21 (disposed in the printer 100) or the pair of conveyance rollers 401 disposed in the preprocessing unit 400. Then, each of lengths L2 and L3 of the paper sheet conveyance path between the gate 13 and the pair of fifth inseparable conveyance rollers 21 and the gate 13 and the pair of conveyance rollers 401, respectively, is about 350 mm or more. When the curved paper sheet path is employed, the radius of curvature (r) is preferably set to about 80 mm or more. According to this modification, even when the paper sheet 8 conveyed from the preprocessing machine is conveyed, the paper sheet 8 can be prevented from returning to the sheet skew once again as well.

As in the above described various embodiments, since the leading end of the paper sheet 8 is butted against the gate 13 as a corrector of correcting the skew of the paper sheet 8 and the paper sheet 8 is continuously conveyed for a predetermined period of time, the leading end of the paper sheet 8 can be aligned with the abutment face of the gate 13 thereby making a right angle with the paper sheet conveyance direction. However, the present invention is not limited to the above-described correcting system of correcting the skew of the paper sheet 8 by using the gate 13, and includes another system of correcting the skew of the paper sheet 8 by bumping a lateral end (i.e., a widthwise end) of the paper sheet against a side fence 500 as shown in FIG. 1. Specifically, as shown in the drawing, in this system of correcting the skew of the paper sheet 8, a bringing roller 501 acting as an oscillating member having an oscillating function is disposed in the paper sheet conveyance path to bring one lateral end of the paper sheet 8 close to an abutment face of the side fence 500 and bumps the one lateral end of the paper sheet 8 thereagainst. That is, the bringing roller 501 bumps the one lateral end of the paper sheet 8 against the abutment face of the side fence 500 so that (the leading end of) the paper sheet 8 can make the right angle with the paper sheet conveyance direction again. Here, a paper sheet lateral end detector is mounted on the side fence to detect an amount of gap between the one lateral end of the paper sheet and the abutment face of the side fence 500. Hence, in accordance with a detection result of the paper sheet lateral end detector, either an amount of bumping length of the bringing roller 501 bumping against the abutment face of the side fence or that of bumping pressure thereof can be adjusted.

The above-described various embodiments are just few examples of the present invention and can respectively provide unique advantages as described herein below.

According to one aspect of the present invention, since the paper sheet is continuously sandwiched by the pair of conveyance rollers for a prescribed period, restoring force generated in the paper sheet in an oblique direction to the paper sheet conveyance direction is inhibited from traveling downstream of the portion of the paper sheet sandwiched by the pair of conveyance rollers even if frictional force is generated when either a surface of the paper sheet on the trailing end region of a portion sandwiched by the pair of conveyance rollers or the trailing end of the paper sheet contacts a guide plate, such as a bottom plate, a ceiling plate, a side plate, etc. At the same time, a conventional problem in that the leading end of the paper enters the skew once again when the restoring force is applied to the portion of the paper sheet sandwiched by the pair of registration rollers can be either suppressed or reduced. Further, when it passes through the portion sandwiched by the pair of conveyance rollers, the trailing end of the paper becomes free providing a free end, and the skew of the trailing end side of the paper is similarly corrected as the portion of the paper sheet sandwiched by the pair of the registration rollers. That is, according to one aspect of the present invention, a sheet conveying device includes a sheet skew corrector to correct a skew of a leading end of a sheet inclining from a sheet conveyance direction and a pair of registration rollers disposed upstream of the sheet skew corrector in the sheet conveyance direction. The pair of registration rollers freely contacts and separates from each other. The pair of registration rollers conveys the sheet downstream of the sheet skew corrector in the sheet conveyance direction when driven at a prescribed time. A pair of conveyance rollers is placed upstream of the pair of registration rollers in the sheet conveyance direction. The pair of conveyance rollers continuously sandwiches the sheet from when the sheet with the skew corrected by the sheet skew corrector is sandwiched by the pair of registration rollers to when a trailing end of the sheet passes between the pair of conveyance rollers.

According to another aspect of the present invention, the number of pairs of conveyance rollers having the separating mechanism can be more effectively minimized while reducing the cost of the sheet conveying device even if the long paper is utilized when compared with a conventional system that increasingly employs the number of pairs of conveyance rollers having the separating mechanism as a paper sheet size used in the system increases in a longitudinal direction. That is, in the above-described sheet conveying device, the pair of conveyance rollers is not connected to a separating mechanism that separates the pair of conveyance rollers from each other.

According to yet another aspect of the present invention, since it is found through an experiment that a leading end of a sheet with the skew corrected does not enter the skew once again if the pair of conveyance rollers is placed at a prescribed position on a sheet conveyance path separated from the sheet skew corrector by a sheet length of about 350 mm or more in a sheet conveyance direction, the pair of conveyance rollers of this embodiment of the present invention is placed at the position on a sheet conveyance path separated from the sheet skew corrector by the paper sheet length of about 350 mm or more in a sheet conveyance direction. With this, even if a portion of the paper sheet downstream of the pair of conveyance rollers contact a guide plate, a conventional problem, in which restoring force is caused by friction generated in the contact area in the oblique direction is applied to a portion of the paper sheet sandwiched by the pair of registration rollers and the leading end of the paper sheet accordingly enters a skew once again, can be either suppressed or reduced. That is, when compared with a situation in which the pair of conveyance rollers is placed at a prescribed position on a sheet conveyance path separated from the sheet skew corrector by a length less about 350 mm in a sheet conveyance direction, since an area of the paper sheet having the torsion thereon is wider, the restoring force of the paper sheet caused by the torsion thereof is widely distributed and the restoring force applied from the contact portion to the portion of the paper sheet sandwiched by the pair of registration rollers becomes weak. Hence, the paper sheet with the skew corrected can avoid returning to the sheet skew once again even if torsion occurs in the paper sheet during the sheet skew correction. That is, in the above-described sheet conveying device, the pair of conveyance rollers is placed at a prescribed position on a sheet conveyance path separated from the sheet skew corrector by a length of about 350 mm or more.

According to yet another aspect of the present invention, since a distance between the pair of conveyance rollers that sandwiches a trailing end region of the paper sheet and the pair of registration rollers is a relatively long, torsional area of the paper sheet increases, and accordingly the restoring force of the paper sheet caused by the torsion therein is widely distributed. As a result, the restoring force applied to the portion of the paper sheet sandwiched by the pair of registration rollers becomes weak, and accordingly the paper sheet with the skew corrected can avoid returning to the sheet skew once again. That is, in the above-described sheet conveying device, the distance on the sheet conveyance path between the pair of conveyance rollers and the sheet skew corrector ranges from about 470 mm to about 530 mm when a length of the sheet in the sheet conveyance direction is about 700 mm.

According to yet another aspect of the present invention, since a contact resistance caused when the paper sheet passes through a curved conveyance path is reduced, and restoring force of the paper sheet caused by the torsion of the paper sheet becomes relatively small, the paper sheet can avoid returning to the sheet skew once again. That is, in the above-described sheet conveying device, the pair of conveyance rollers is placed on a curved sheet conveyance path, the curved sheet conveyance path having a radius of curvature of about 80 mm or more.

According to yet another aspect of the present invention, since the paper sheet conveyance path is linear, contact resistance applied to the paper sheet during passing through the paper sheet conveyance path is almost neglected. As a result, the paper sheet can avoid returning to the sheet skew once again. That is, in the above-described sheet conveying device, the radius of curvature of the curved sheet conveyance path is infinity.

According to yet another aspect of the present invention, the portion of the paper sheet sandwiched by the pair of registration rollers is not directed obliquely and accordingly the paper sheet does not return to the sheet skew back again thereby resolving the conventional problem, and accordingly the paper sheet is not sent to the transfer unit in the skew. Hence, an image created by an image forming device is borne in an appropriate position in a sheet. That is, an image forming apparatus includes an image forming device to form an image on a sheet and the above-described sheet conveying device to convey the sheet toward the image forming device.

According to yet another aspect of the present invention, the paper sheet fed from a preprocessing machine is conveyed while inhibiting the paper sheet from returning to the sheet skew once again. Hence, an image created by an image forming device is borne in an appropriate position on a sheet again. That is, the image forming apparatus further includes a preprocessing unit 400 detachably attached to the image forming apparatus and having a pair of preprocess sheet conveyance rollers. The pair of preprocess sheet conveyance rollers continuously sandwiches a sheet conveyed from the preprocessing machine at least from when the skew of the sheet is corrected by the sheet skew corrector and the pair of registration rollers sandwiches the sheet therebetween to when a trailing end of the sheet passes between the pair of preprocess sheet conveyance rollers.

Numerous additional modifications and variations of the present invention are possible in light of the above teachings. It is therefore to be understood that within the scope of the appended claims, the present invention may be executed otherwise than as specifically described herein. For example, the sheet conveying device is not limited to the above-described various embodiments and modifications and may be altered as appropriate. Also, the image forming apparatus is not limited to the above-described various embodiments and modifications and may be altered as appropriate. Further, the method of correcting a skew of a sheet is not limited to the above-described various embodiments and may be altered as appropriate. For example, a step of the method of forming an image can be altered as appropriate.

What is claimed is:

1. A sheet conveying device comprising:

a first sheet skew corrector configured to correct a skew of a leading end of a sheet inclining from a sheet conveyance direction;

a pair of registration rollers upstream of the first sheet skew corrector in the sheet conveyance direction, the pair of registration rollers configured to freely contact and separate from each other, and to convey the sheet downstream of the first sheet skew corrector in the sheet conveyance direction when contacting each other and driven at a prescribed time;

a pair of conveyance rollers upstream of the pair of registration rollers in the sheet conveyance direction to form a sheet conveyance path between the pair of conveyance rollers and the pair of registration rollers, the pair of conveyance rollers configured to continuously sandwich the sheet from a first time to a second time, the first time being a time when the sheet with the skew corrected by the first sheet skew corrector is sandwiched by the pair of registration rollers and the second time being a time when a trailing end of the sheet passes between the pair of conveyance rollers; and a pair of bumping rollers on the sheet conveyance path between the pair of registration rollers and the pair of conveyance rollers, the pair of bumping rollers configured to, convey and bump the sheet with the leading end skewed against the first sheet skew corrector to form a deflection in the sheet between the first sheet skew corrector and the pair of bumping rollers, and separate from each other to open the sheet conveyance such that, the sheet conveying device holds the sheet with the deflection formed therein by only the pair of registration rollers sandwiching the leading end of the sheet and the pair of conveyance rollers sandwiching the trailing end of the sheet and the pair of registration rollers close to sandwich the sheet before the pair of bumping rollers and a pair of driving rollers separate from each other, wherein the sheet conveying device is configured to operate based on signals received from a controller, the controller configured to generate the signals based at least on sensor data provided thereto from one or more sensors, the sensor data providing an indication of a position of the sheet along the sheet conveyance path.

2. The sheet conveying device as claimed in claim 1, wherein the pair of registration rollers are configured to, separate from each other to allow the sheet to pass therethrough when the first sheet skew corrector corrects the skew of the leading end of the sheet inclining from the sheet conveyance direction, contact each other after the first sheet skew corrector has corrected the skew of the leading end of the sheet to sandwich the sheet with the skew of the leading end corrected therebetween, and convey the sheet with the skew of the leading end corrected downstream at a prescribed time.

3. The sheet conveying device as claimed in claim 2, wherein the pair of registration rollers are configured to contact each other after the sheet has bumped the first sheet skew corrector to correct the skew of the leading end of the sheet such that the pair of registration rollers sandwich the sheet before the pair of bumping rollers and the pair of driving rollers separate from each other.

4. The sheet conveying device as claimed in claim 1, further comprising:

a second sheet skew corrector including, a side fence at a lateral end of the sheet conveyance path, the side fence configured to be butted and align the sheet with the leading end skewed when the sheet is bumped thereagainst; and a bumping member configured to bump a lateral end of the sheet with the leading end skewed against the side fence.

5. The sheet conveying device as claimed in claim 1, further comprising:

at least a pair of driving rollers configured to convey the sheet downstream from the pair of conveyance rollers to the pair of bumping rollers, wherein the pair of driving rollers are configured to separate from the pair of bumping rollers in accordance with a length of a sheet to be conveyed therebetween, and the pair of driving rollers are configured to separate from each other to open the sheet conveyance path when the deflection is formed near the leading end of the sheet to collectively cancel a restoring force generated in the sheet together with the pair of bumping rollers.

6. The sheet conveying device as claimed in claim 1, further comprising:

a guide plate at least extended from the pair of conveyance rollers to the pair of registration rollers along the sheet conveyance path, wherein the pair of conveyance rollers are configured to continuously sandwich the sheet from the first time to the second time to block transmission of a frictional force generated at the trailing end of the sheet due to the sheet contacting the guide plate from being transmitted downstream toward the pair of registration rollers.

7. The sheet conveying device as claimed in claim 6, wherein the pair of registration rollers and the pair of conveyance rollers are separated by a gap in the sheet conveyance path, the gap allowing the deflection to form in the sheet.

8. The sheet conveying device as claimed in claim 1, wherein the pair of conveyance rollers is at a prescribed position on the sheet conveyance path to sandwich the sheet near a trailing end of the sheet when the deflection is formed near the leading end of the sheet upstream of the pair of registration rollers contacting each other.

9. The sheet conveying device as claimed in claim 1, wherein the pair of conveyance rollers are configured to remain in continuous contact with each other.

10. The sheet conveying device as claimed in claim 1, wherein the pair of conveyance rollers are at a prescribed position on the sheet conveyance path separated from the first sheet skew corrector by a length of at least 350 mm.

11. The sheet conveying device as claimed in claim 10, wherein the sheet conveyed by the sheet conveying device has a length of at least 700 mm in the sheet conveyance direction.

12. The sheet conveying device as claimed in claim 10, wherein a distance on the sheet conveyance path between the pair of conveyance rollers and the first sheet skew corrector ranges from 470 mm to 530 mm when a length of the sheet in the sheet conveyance direction is at least 700 mm.

13. The sheet conveying device as claimed in claim 1, wherein the pair of conveyance rollers are on the sheet conveyance path, the sheet conveyance path being curved with a radius of curvature of at least 80 mm.

14. The sheet conveying device as claimed in claim 1, wherein the pair of conveyance rollers are on the sheet conveyance path, the sheet conveyance path being linear.

15. An image forming apparatus comprising:

an image forming device configured form an image on a sheet; and the sheet conveying device of claim 1, the sheet conveyance device configured to convey the sheet toward the image forming device.

16. The image forming apparatus as claimed in claim 15, further comprising:

a preprocessing machine having a pair of first preprocess sheet conveyance rollers on a preprocess sheet conveyance path upstream of the pair of registration rollers, the pair of first preprocess sheet conveyance rollers disconnected from a separating mechanism that separates the pair of conveyance rollers the preprocess sheet conveyance path extending from the pair of first preprocess sheet conveyance rollers toward the pair of registration rollers, the pair of first preprocess sheet conveyance rollers configured to continuously sandwich the sheet conveyed from the preprocessing machine at least from the first time to a third time, the third time being a time when the trailing end of the sheet passes between the pair of first preprocess sheet conveyance rollers.

17. The image forming apparatus as claimed in claim 16, further comprising:

a pair of second preprocess sheet conveyance rollers configured to convey the sheet conveyed from the pair of first preprocess sheet conveyance rollers downstream to the pair of bumping rollers, the pair of second preprocess sheet conveyance rollers disconnected from the separating mechanism, wherein the pair of second preprocess sheet conveyance rollers is spaced apart from the first sheet skew corrector in accordance with a length of the sheet conveyed from the preprocessing machine, and the pair of second preprocess sheet conveyance rollers is configured to continuously sandwich the sheet from the first time to a fourth time, the fourth time being a time when the trailing end of the sheet passes between the pair of second preprocess sheet conveyance rollers.

18. The sheet conveying device as claimed in claim 1, wherein the sheet conveying device is configured to control at least the pair of registration rollers, the pair of conveyance rollers, and the pair of bumping rollers based on the signals received from the controller.

19. A method of correcting a skew of a sheet via a sheet conveying device, the method comprising:

conveying a sheet downstream along a sheet conveyance path with a pair of conveyance rollers toward a pair of registration rollers in a sheet conveyance direction while sandwiching the sheet therebetween;

separating the pair of registration rollers from each other to open the sheet conveyance path to allow the sheet conveyed by the pair of conveyance rollers to pass therethrough;

conveying, via a pair of bumping rollers, the sheet inclining from the sheet conveyance direction though the pair of registration rollers when the pair of registration rollers are separated from each other, the pair of bumping rollers being between the pair of conveyance rollers and the pair of registration rollers;

bumping a leading end of the sheet with the pair of bumping rollers against a sheet skew corrector downstream of the pair of registration rollers in the sheet conveyance direction;

correcting a skew of the leading end of the sheet with the sheet skew corrector by further conveying the sheet after bumping the leading end of the sheet against the sheet skew corrector downstream for a period of time to form a deflection in the sheet;

sandwiching the sheet with the skew of the leading end corrected by bringing the pair of registration rollers in contact with each other to close the sheet conveyance path such that the pair of registration rollers close to sandwich the sheet before the pair of bumping rollers and a pair of driving rollers separate from each other;

separating the pair of bumping rollers from each other to open the sheet conveyance path such that, the sheet with the deflection formed therein is held by only the pair of registration rollers sandwiching the leading end of the sheet and the pair of conveyance rollers sandwiching a trailing end of the sheet;

retracting the sheet skew corrector from the sheet conveyance path to open the sheet conveyance path;

driving the pair of registration rollers sandwiching the sheet therebetween at a prescribed time;

conveying the sheet downstream of the sheet skew corrector in the sheet conveyance direction with the pair of registration rollers; and continuously sandwiching the sheet with the pair of conveyance rollers from a first time to a second time, the first time being a time when the sandwiching sandwiches the sheet with the skew of the leading end corrected by bringing the pair of registration rollers in contact with each other to close the sheet conveyance path and the second time being a time when the trailing end of the sheet with the skew of the leading end corrected passes between the pair of conveyance rollers.

* * * * *